United States Patent [19]

Hazenveld

[11] 4,221,310

[45] Sep. 9, 1980

[54] GARMENT HANGER

[76] Inventor: Martin G. Hazenveld, P.O. Box 90, 5750 Ab Deurne, Netherlands

[21] Appl. No.: 4,077

[22] Filed: Jan. 17, 1979

[30] Foreign Application Priority Data

Jan. 23, 1978 [NL] Netherlands ..... 7800793

[51] Int. Cl.[2] ..... A47J 51/10

[52] U.S. Cl. ..... 223/94

[58] Field of Search ..... 223/89, 94, 95, 92, 223/93

[56] References Cited

U.S. PATENT DOCUMENTS

| | | | |
|---|---|---|---|
| 2,259,692 | 10/1941 | Hegedus | 223/95 |
| 2,409,700 | 10/1946 | Loselle | 223/95 |
| 2,488,072 | 11/1949 | Stewart | 223/95 |
| 2,507,906 | 5/1950 | Joseph . | |
| 2,570,043 | 10/1951 | Ambrosino et al. . | |
| 2,977,032 | 3/1961 | Metzner . | |
| 3,054,540 | 9/1962 | Wylie . | |
| 3,070,270 | 12/1962 | Campagnolo | 223/95 |
| 3,401,855 | 9/1968 | Balzer et al. | 223/94 |
| 3,460,726 | 8/1969 | Rooz | 223/95 |

FOREIGN PATENT DOCUMENTS

| | | |
|---|---|---|
| 1144094 | 4/1957 | France . |
| 795960 | 6/1958 | United Kingdom . |

*Primary Examiner*—George H. Krizmanich

*Attorney, Agent, or Firm*—Diller, Ramik & Wight

[57] ABSTRACT

A garment hanger having a base element which comprises two upwardly inclined tensioning arms destined for carrying garment at their free ends, said tensioning arms being connected to each other or to a central body by means of hinged junctions, and a top element which comprises two downwardly inclined connecting arms of half the length or substantially half the length of the tensioning arms, said connecting arms being connected to each other or to a central body by means of hinged junctions and being connected to the tensioning arms at places halfway these tensioning arms by means of hinged junctions. Further, spring means (preferably realized by forming the hinged junctions as spring junctions) are provided for urging the top element and base element together, and a suspension hook is present for suspending the hanger and garment.

10 Claims, 7 Drawing Figures

GARMENT HANGER

Figure 1:
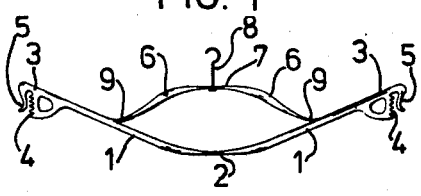

This invention relates to a garment hanger which has been devised predominantly for suspending skirts and similar garments but which may also be used with advantage for suspending other articles of manufacture.

A known garment hanger for this purpose has two tensioning arms in line, said arms being telescopically mounted on a central body with suspension hook. During use, the hanger is introduced into the garment with its tensioning arms in inserted condition, whereupon the tensioning arms are released so as to allow them to move out under spring action until their free ends engage the garment and exert a tensioning force onto it. The combination of garment and hanger may then be suspended in the resulting state.

An advantage of this known hanger is that it may be used for garments of varying diameters and that the free ends of the tensioning arms will always move in a horizontal plane when changing their position, thus causing the garments to be suspended always at the same level with regard to the suspension hook. Disadvantages are, however, that the hanger should have a firm construction in order to prevent bending and that many auxiliary parts such as means for pushing the tensioning arms out and keeping them out, are necessary. The variety of these parts and their way of mounting make the known hanger relatively expensive.

Another known garment hanger has two upwardly inclined tensioning arms extending on either side of a rigid triangular body provided with a suspension hook, said arms being connected to the small base of the triangular body by means of spring junctions. During use, this hanger is introduced into a garment with its tensioning arms in raised position, whereupon the tensioning arms are released so as to allow them to engage the garment. The weight of the garment will then ensure a further stretching of the tensioning arms and provide the required tensioning force, whereupon the combination of garment and hanger may be suspended at any place.

An advantage of this second known hanger is that no firm construction and no auxiliary parts are needed, thus making it relatively cheap in manufacturing price. A disadvantage is, however, that the free ends of the tensioning arms will describe a curved line during their movement, thus causing garments of varying diameter to be suspended on different levels with regard to the suspension hook. Additional disadvantages are that the bearing surfaces at the free ends of the tensioning arms will take different positions with varying garment diameters, and moreover, that the tensioning force in the hanger is dependent from the garment weight which may lead to problems in the case of hanging transportations.

The invention has for its object to provide a garment hanger which shows the advantages of both known hangers without having the disadvantages thereof.

The invented garment hanger has a base element which comprises two upwardly inclined tensioning arms adapted for carrying a garment or other article at their free ends and being connected to each other or to a central body by means of hinged junctions, and a top element which comprises two downwardly inclined connecting arms having half the length or substantially half the length of the tensioning arms, said connecting arms being connected to each other or to a central body by means of hinged connections and said connecting arms being connected to the tensioning arms at places halfway or substantially halfway the tensioning arms by means of hinged junctions. Further, the invented hanger comprises spring means for urging the top element and base element together, and a suspension element such as a hook.

In the invented hanger, the tensioning arms together with the connecting arms and any central bodies will form a quadrangle or a hexagon, respectively wherein the angular points are formed by the hinged junctions. This provides a firm construction capable of bearing relatively high weights. Further, the spring means present will try to urge the top and base of the quadrangle or hexagon together and will ensure thereby a high internal resilience causing the tensioning arms to stretch. During use, the hanger is introduced into a garment with both tensioning arms in raised position, or loops of the garment are engaged to hooks at the free ends of the tensioning arms, whereupon the tensioning arms are released so as to allow them to stretch and to engage the garment under the exertion of a tensioning force. In contradiction to the known hanger with upwardly inclined tensioning arms, the tensioning force is not provided predominantly by the garment weight but exclusively or substantially exclusively by the inherent resilience of the hanger. The combination of garment and hanger may then be suspended in the resulting state.

Thanks to the combination of tensioning arms and connecting arms, the invented hanger will show a reasonably high firmness and will need no or substantially no auxiliary parts for keeping the tensioning arms in stretched condition, thus resulting in a low manufacturing price. Moreover, thanks to the special engagement place of the connecting arms to the tensioning arms, as well as to their length ratio, the free ends of the tensioning arms will always describe a horizontal or substantially horizontal course when changing their position, thus causing the garments to be suspended always at the same or substantially the same level with regard to the suspension element (for example a hook). In this way, the invented hanger will satisfy the object of the invention.

In a special embodiment, the base element still comprises one or more additional tensioning arms which extend parallel to the aforesaid tensioning arms and which are connected to each other or to a central body by means of hinged junctions. In this case, the central places or central bodies of all pairs of tensioning arms are interconnected by means of a common body and the free ends of all tensioning arms on each side of the base element are interconnected by a common cross arm by means of hinged junctions.

If the hinged junctions are formed as spring junctions, this construction will result in a higher resilience and will exert a higher tensioning force, thus being capable of bearing higher garment weights. Moreover, the cross-arms on either side of the hanger will always remain in the same (preferably vertical) position during any movement of the multiple tensioning arms; in view of the fact that these cross-arms will form the garment bearing surfaces, and this is a clear advantage.

The spring means which are needed in all embodiments for providing the required resilience and tensioning force may be realised in several different ways. To this end, it is advantageous to realise at least one of the hinged junctions and preferably all hinged junctions between the several parts in the form of spring junctions. Nevertheless, it is also possible to arrange one or more tensioning springs or other springs or combinations thereof adjacent to or in the hinged junctions or between the top element and base element, in addition to or instead of the just-mentioned spring junctions.

The invention will now be illustrated by the drawing which shows some embodiments of the invented garment hanger by way of example.

FIGS. 1–4 show four embodiments of the dress hanger according to the invention.

Figure 2:
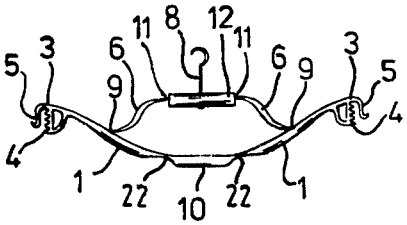
Figure 3:
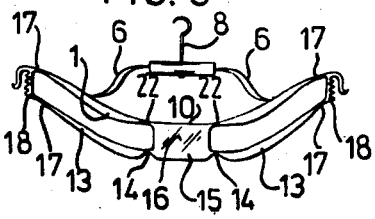
Figure 5:
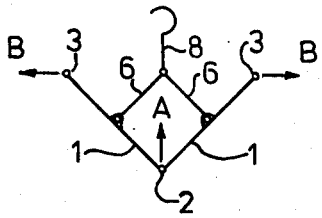
Figure 6:
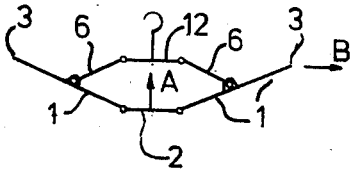
Figure 7:
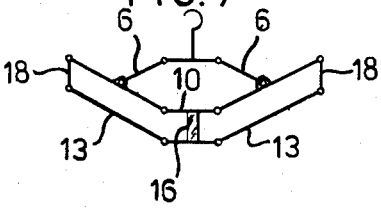

FIGS. 5 and 6 and 7 illustrate the principle of the embodiments of FIGS. 1 and 2 and 3, respectively in a diagrammatical way.

A first, simple embodiment of the invented garment hanger is shown in FIG. 1. This embodiment has a base element of two upwardly inclined tensioning arms, 1,1 which are connected to each other by means of a spring junction 2 providing at the same time for a hinged connection and for spring means. The tensioning arms are destined to carry a skirt or similar garment at their free ends and to this purpose, they have been provided with a wide bearing surface 4,4 and a stop 5,5. Further, the hanger has a top element of two downwardly inclined connecting arms 6,6 which are connected to each other by means of a spring junction 7 which provides for a hinged connection and for spring means at the same time. A suspension hook 8 has been mounted on this spring junction 7. The connecting arms 6,6 have substantially half the length of the tensioning arms 1,1 and engage the tensioning arms 1,1 at a place substantially halfway of these tensioning arms, by means of spring junctions 9,9 which provide for hinged junctions and spring means at the same time.

The hanger of FIG. 1 is diagrammatically shown in FIG. 5. It can be seen here that the connecting arms 6,6 form a quadrangle with the tensioning arms 1,1 and that the angular points of this quadrangle are hinged points. Thanks to the realisation of these hinged points as spring junctions, spring means are present which exert a compressing force in vertical direction to the quadrangle according to the arrow A. This force A will form the resilience in the hanger and will result in an outwardly directed force according to the arrows B,B exerted onto the free ends 3,3 of the tensioning arms, which provide the tensioning arms with a tendency to stretch and to exert the required tensioning force onto a garment. Thanks to the fact that the connecting arms 6,6 have substantially half the length of the tensioning arms 1,1 and that they engage substantially halfway, there is provided a transmission ratio which ensures that the free ends 3,3 of the tensioning arms 1,1 will only move in substantially horizontal direction when changing their position.

During use of this embodiment, the hanger is introduced into a skirt or other garment with its tensioning arms 1,1 in slightly raised position whereupon the tensioning arms are released. As a result of the inherent resilience, the tensioning arms will stretch then and will engage the garment under exertion of a suitable tensioning force. This garment may then be suspended in tensioned state by means of the suspension hook 8. It will be clear that garments of varying diameter will always be suspended at the same level with regard to the suspension hook, thanks to the substantially horizontal movement of the free ends of the tensioning arms.

A second embodiment of the invented hanger is shown in FIG. 2. This embodiment differs from the first embodiment by the fact that both tensioning arms 1,1 are connected to a central body 10 by means of spring junctions 22,22 and by the fact that the tensioning arms 6,6 are connected to a central body 12 (carrying the suspension hook 8) by means of spring junctions 11,11. The spring junctions 22,22 and 11,11 provide for hinged connections as well as for spring means. The central bodies 10,12 will form a hexagon with the connecting arms 6,6 and the tensioning arms 1,1 and the angular points thereof are formed by hinged junctions (compare FIG. 6). The spring means as present will exert a vertical force A which urges both central bodies 10,12 together. This resilience force also provides for outwardly directed forces B exerted on the free ends 3 of the tensioning arms. Thanks to the special length ratio between connecting arms and tensioning arms, the free ends 3 will move again in a substantially horizontal direction when changing of position.

The hanger of FIG. 2 is used in the same way as that of FIG. 1 and the tensioning force exerted onto the garment is obtained predominantly by the inherent resilience of the hanger. Garments of varying diameter will always be suspended at the same level.

A third embodiment of the invented hanger is shown in FIG. 3. This embodiment differs from the second embodiment by the presence of an additional pair of tensioning arms 13,13 extending parallel or substantially parallel to the tensioning arms 1,1. These additional tensioning arms 13,13 are connected to a central body 15 by means of spring junctions 14 which provide for hinged connections as well as spring means, and the central body 15 is connected by a rigid body 16 with the central body 10 of the tensioning arms 1,1. At each side of the hanger, the free ends of the tensioning arms 1 and 13 are interconnected by a cross-arm 18 in such a way that both the tensioning arm 1 and the tensioning arm 13 are connected by means of a spring junction 17,17 to this cross-arm 18, such spring junction providing for a hinged connection as well as for spring means. The cross-arms 18,18 have bearing surfaces 4,4 and stops 5,5.

In the hanger of FIG. 3, a hexagon having inherent resilience (compare FIG. 7) is formed by the tensioning arms 1,1 together with the connecting arms 6,6 and central bodies 8,10. This hexagon provides the same advantages as in the embodiment of FIG. 2. Further, a parallelogram having hinged angular points is formed on each side of the hanger by means of the tensioning arms 1 and 13 with the cross-arm 18 and the central body 16. If the tensioning arms 1,1 are pivoted, the arms 13,13 will also be pivoted but the cross-arms 18,18 will always remain in the same vertical position, thus causing the bearing surfaces 4,4 also to remain vertical. Moreover, the additional spring means as present in said parallelogram will provide for a higher resilience within the hanger.

During use of the hanger of FIG. 3, garments of varying diameter will always be suspended at the same or substantially the same level with regard to the suspension hook. A further advantage is that the bearing surfaces for the garments will always remain vertical or substantially vertical so as to ensure an optimum tensioning of the garments. Moreover, the additional resilience within the hanger will provide for a higher total tensioning force, thus allowing the hanger to carry heavier garments.

Figure 4:
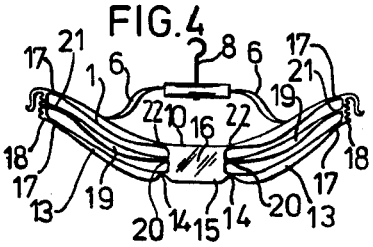

A fourth embodiment of the invented hanger is shown in FIG. 4. This embodiment differs from the third embodiment by the presence of a third pair of tensioning arms 19,19 extending parallel to the tensioning arms 1,1 and 13,13. These tensioning arms 19,19 are connected to a central body being part of the rigid body 16 by means of spring junctions 20,20, and are connected to the cross-arms 18,18 by means of spring junctions 21,21. The spring junctions provide for hinged connections as well as for spring means. In operation, this embodiment is similar to that of FIG. 3 but its total resilience and its tensioning force are still higher, thus allowing it to carry still heavier garments.

Many variants to the embodiments as shown are possible. Thus, the central bodies 12 and 10 and 15 in the embodiments of FIGS. 3 and 4 might be omitted so as to cause the connecting arms as well as the tensioning arms to be connected directly to each other by means of spring junctions. In this case, only a rigid body 16 should be present between the connecting points of the tensioning arms 1,1 and 13,13 or between the connecting points of 11,11 and 13,13 and 19,19, respectively.

Further, the hinged junctions between several parts need not always be spring junctions. It is possible to realise all of these hinged junctions as simple fulcrum points and to arrange spring means in the form of one or more tension springs or other springs or combinations thereof adjacent to or in these fulcrum points or at any place between the top element and the base element. Nevertheless, the use of at least one spring junction has certain advantages because such a spring junction may simply be realised by contraction of the part in question when the whole garment hanger is manufactured from synthetic resin. Preferably, all hinged junctions are spring junctions like shown in the drawing.

In the case that the hinged junctions are only simple fulcrum points, then the connecting arms should exactly have half the length of the tensioning arms and should engage these tensioning arms exactly halfway so as to allow the free ends of the tensioning arms to move in a horizontal plane. In the case, however, that the said junctions are spring junctions, then the length of the spring junctions should be taken into account. In that case, the connecting arms should have substantially half the length of the tensioning arms and should engage these tensioning arms substantially halfway. The free ends of the tensioning arms will move then in a substantially horizontal plane.

Other possible variants relate to the bearing surfaces 4,4 and stops 5,5 which may be replaced with the same advantage by bearing, engaging and/or stop means of other shape. Thus, it is possible to arrange hooks or eyelets adjacent to or in stead of the bearing surfaces 4,4 in order to fasten the garment thereto by means of loops. During utilisation of this variant, the tensioning arms are raised first, whereupon the loops of the garment are fastened to the said hooks or eyelets and the tensioning arms are released. The tensioning arms will stretch themselves then as a result of the inherent resilience and the garment will be tensioned to the same extent as in the embodiments as shown.

Further, the suspension hook 8 may be replaced by any other suspension element, if desired.

Finally, it is remarked that the garment hanger of the invention is not only suitable for suspending garments in tensioned state but also suitable for suspending dress covers, bags and other articles of manufacture.

What I claim is:

1. A garment hanger comprising a base element including two upwardly inclined tensioning arms having adjacent ends and remote ends, first means for hingedly connecting together said adjacent ends, a top element including two downwardly inclined connecting arms of substantially half the length of said tensioning arms, said connecting arms having adjacent ends and remote ends, second means for hingedly connecting together said connecting arms adjacent ends, third means for hingedly connecting one of said connecting arm remote ends to one of said tensioning arms substantially medially of the adjacent and remote ends of said one tensioning arm, fourth means for hingedly connecting another of said connecting arm remote ends to another of said tensioning arms substantially medially of the adjacent and remote ends of said another tensioning arm, means for urging said top element and said base element relatively toward each other, and means connected directly to only said top element contiguous said second hinge connecting means for suspending said hanger from a suitable support.

2. The garment hanger as defined in claim 1 wherein said urging means is defined by the natural resilience of said hanger at said first through fourth hinge connecting means.

3. The garment hanger as defined in claim 1 wherein said urging means is defined by the natural resilience of said hanger at at least one of said first through fourth hinge connecting means.

4. The garment hanger as defined in claim 1 wherein said base element includes at least another two upwardly inclined tensioning arms disposed in generally parallel relationship to said first-mentioned tensioning arms, a pair of cross arms, fifth and sixth means for hingedly connecting together one of said cross arms and remote ends of one each of said first and second-mentioned two upwardly inclined tensioning arms, seventh and eighth means for hingedly connecting together another of said cross arms and remote ends of one each of said first and second mentioned two upwardly inclined tensioning arms, and ninth means for hingedly connecting together adjacent ends of said second-mentioned two upwardly inclined tensioning arms.

5. The garment hanger as defined in claim 1 wherein said second hinge connecting means includes first and second hinge connecting portions on opposite sides of a central body, and said suspending means is connected to said central body.

6. The garment hanger as defined in claim 1 wherein said first hinge connecting means includes first and second hinge connecting portions on opposite sides of a central body, said second hinge connecting means includes first and second hinge connecting portions on opposite sides of another central body, and said suspending means is connected to said another central body.

7. The garment hanger as defined in claim 1 wherein said first hinge connecting means includes first and second hinge connecting portions on opposite sides of a central body, said second hinge connecting means includes first and second hinge connecting portions on opposite sides of another central body, said suspending means is connected to said another central body, and said first-mentioned and another central bodies, said connecting arms, and portions of said two tensioning arms between said third and fourth hinge connecting means are disposed in a generally hexagonal configuration.

8. The garment hanger as defined in claim 4 wherein said second hinge connecting means includes first and second hinge connecting portions on opposite sides of a central body, and said suspending means is connected to said central body.

9. The garment hanger as defined in claim 4 wherein said first hinge connecting means includes first and second hinge connecting portions on opposite sides of a central body, said second hinge connecting means includes first and second hinge connecting portions on opposite sides of another central body, and said suspending means is connected to said another central body.

10. The garment hanger as defined in claim 9 wherein said ninth hinge connecting means includes first and second hinge connecting portions on opposite sides of said first-mentioned central body.

* * * * *